US006273829B1

(12) United States Patent
Carlson et al.

(10) Patent No.: US 6,273,829 B1
(45) Date of Patent: Aug. 14, 2001

(54) METAL MATRIX COMPOSITE SHAFTS FOR GOLF CLUBS

(75) Inventors: Larry Carlson, Newhall; Kirk Litzinger, Simi Valley, both of CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 09/235,707

(22) Filed: Jan. 22, 1999

Related U.S. Application Data

(60) Provisional application No. 60/072,476, filed on Jan. 26, 1998.

(51) Int. Cl.[7] ..... A63B 53/12
(52) U.S. Cl. ..... 473/316; 473/320
(58) Field of Search ..... 473/316, 317, 473/318, 319, 320, 321, 322, 323

(56) References Cited

U.S. PATENT DOCUMENTS 4,786,467 * 11/1988 Skibo .
4,946,500 * 8/1990 Zedalis ..... 75/236
5,573,467 * 11/1996 Chou ..... 473/289
5,792,007 * 8/1998 Billings ..... 473/305
5,980,602 * 11/1999 Carden ..... 75/236

* cited by examiner

*Primary Examiner*—Jeanette Chapman
*Assistant Examiner*—Stephen L. Blau
(74) *Attorney, Agent, or Firm*—Roth & Goldman

(57) ABSTRACT

Formed tubular sporting articles subjected to repeated flexure such as golf club shafts are made from metal matrix composite materials (MMCs) in which a metal alloy matrix is discontinuously reinforced with undissolved particles or platelets in proportions to result in an article having a variable wall thickness, and a minimum modulus of elasticity of 10.4 and a minimum yield strength and minimum modulus of elasticity related by the equation:

$$Y=71+6.84(E-10.4)$$

where Y is yield strength in KSI and E is modulus of elasticity in units$\times 10^6$ psi. The sporting articles are lighter than conventional and have a modulus of elasticity substantially less than that of ordinary MMCs.

14 Claims, 7 Drawing Sheets

IRON TIP ANALYSIS (.370")

| PARAM | UNITS | 1 | 2 | 3 | 4 | 5 | 6 | 7 | 8 | 9 |
|---|---|---|---|---|---|---|---|---|---|---|
| ALLOY: | | 7001 | MMC | MMC | MMC | MMC | MMC | MMC | MMC | MMC |
| Density | lbs/in3 | 0.103 | 0.103 | 0.103 | 0.103 | 0.103 | 0.103 | 0.103 | 0.103 | 0.103 |
| Modulus | msi | 10.3 | 11.9 | 11.6 | 12.6 | 12.6 | 13.9 | 14.0 | 16.0 | 16.0 |
| Size | | | | | | | | | | |
| OD | in | 0.370 | 0.370 | 0.370 | 0.370 | 0.370 | 0.370 | 0.370 | 0.370 | 0.370 |
| Wall | in | 0.050 | 0.053 | 0.049 | 0.046 | 0.043 | 0.041 | 0.038 | 0.033 | 0.030 |
| Length | in | 8.00 | 8.00 | 8.00 | 8.00 | 8.00 | 8.00 | 8.00 | 8.00 | 8.00 |
| ID | in | 0.2500 | 0.2640 | 0.2720 | 0.2760 | 0.2640 | 0.2690 | 0.2876 | 0.3040 | 0.3100 |
| I | in 4 | 0.0007 | 0.0007 | 0.0007 | 0.0006 | 0.0006 | 0.0006 | 0.0005 | 0.0005 | 0.0005 |
| Weight | | | | | | | | | | |
| Wt//pc | grams | 22 | 20 | 18 | 18 | 17 | 16 | 14 | 13 | 12 |
| Pct. of Base | | 100 | 90 | 85 | 80 | 75 | 72 | 65 | 60 | 55 |
| Wt./pc. | lbs. | 0.048 | 0.043 | 0.041 | 0.039 | 0.036 | 0.035 | 0.031 | 0.029 | 0.026 |
| Wt./in | lbs. | 0.006 | 0.005 | 0.005 | 0.006 | 0.005 | 0.004 | 0.004 | 0.004 | 0.003 |
| Wt./ft | lbs. | 0.072 | 0.065 | 0.061 | 0.068 | 0.068 | 0.052 | 0.047 | 0.043 | 0.040 |

FIG. 1A

| | | | | | | | | | |
|---|---|---|---|---|---|---|---|---|---|
| Strength | | | | | | | | | |
| Yld ksi | 68 | 94 | 98 | 102 | 107 | 111 | 120 | 126 | 136 |
| Ult. ksi | | | | | | | | | |
| M-yld. in-lbs | 346 | 346 | 344 | 345 | 347 | 346 | 346 | 348 | 347 |
| Pct. of Base | 100 | 100 | 100 | 100 | 100 | 100 | 100 | 100 | 100 |
| M-Ult. in-lbs | 0 | 0 | 0 | 0 | 0 | 0 | 0 | 0 | 0 |
| Yield Pr psi | 422.4 | 377.42 | 353.09 | 337.55 | 324.01 | 311.11 | 291.94 | 277.69 | 267.10 |
| Burst Pr psi | 0 | 0 | 0 | 0 | 0 | 0 | 0 | 0 | 0 |
| Deflection | | | | | | | | | |
| Span 30 in/lb | 0.075 | 0.075 | 0.075 | 0.075 | 0.075 | 0.075 | 0.075 | 0.075 | 0.075 |
| Bend Sti lb/in | 13.3 | 13.3 | 13.3 | 13.3 | 13.3 | 13.3 | 13.3 | 13.3 | 13.2 |
| Pct. of Base | 100 | 100 | 100 | 100 | 100 | 100 | 100 | 100 | 100 |
| Cantil. 3 in | 1.202 | 1.203 | 1.204 | 1.199 | 1.201 | 1.201 | 1.204 | 1.200 | 1.200 |
| Bend Sti lb/in | 0.8 | 0.8 | 0.8 | 0.8 | 0.8 | 0.8 | 0.8 | 0.8 | 0.8 |
| Twist deg/ft-l | 0.0064 | 0.0064 | 0.0064 | 0.0064 | 0.0064 | 0.0064 | 0.0064 | 0.0064 | 0.0064 |
| Tor. Stiff in-lb/d | 156.27 | 156.19 | 156.04 | 156.70 | 156.42 | 156.42 | 156.02 | 156.46 | 155.56 |

FIG. 1B

WOOD TIP ANALYSIS (.375")

| PARAM | UNITS | 1 | 2 | 3 | 4 | 5 | 6 | 7 | 8 | 9 |
|---|---|---|---|---|---|---|---|---|---|---|
| ALLOY: | | 7001 | MMC | MMC | MMC | MMC | MMC | MMC | MMC | MMC |
| Density | lbs/in3 | 0.103 | 0.103 | 0.103 | 0.103 | 0.103 | 0.103 | 0.103 | 0.103 | 0.103 |
| Modulus | msi | 10.3 | 11.0 | 11.6 | 12.0 | 12.5 | 13.0 | 14.0 | 15.0 | 16.0 |
| Size | in | 0.375 | 0.375 | 0.375 | 0.375 | 0.375 | 0.375 | 0.375 | 0.375 | 0.375 |
| OD | in | 0.050 | 0.045 | 0.042 | 0.040 | 0.037 | 0.035 | 0.032 | 0.029 | 0.027 |
| Wall | in | 8.00 | 8.00 | 8.00 | 8.00 | 8.00 | 8.00 | 8.00 | 8.00 | 8.00 |
| Length | in | 0.2750 | 0.2850 | 0.2910 | 0.0296 | 0.3010 | 0.3050 | 0.3114 | 0.3170 | 0.3220 |
| ID | in 4 | 0.0007 | 0.0006 | 0.0006 | 0.0006 | 0.0006 | 0.0005 | 0.0005 | 0.0005 | 0.0004 |
| I | | | | | | | | | | |
| Weight | | | | | | | | | | |
| Wt//pc | grams | 19 | 17 | 16 | 16 | 15 | 14 | 13 | 12 | 11 |
| Pct. of Base | | 100 | 91 | 86 | 82 | 77 | 73 | 67 | 62 | 57 |
| Wt/pc. | lbs. | 0.042 | 0.038 | 0.036 | 0.034 | 0.032 | 0.031 | 0.028 | 0.026 | 0.024 |
| Wt./in. | lbs. | 0.005 | 0.005 | 0.005 | 0.004 | 0.004 | 0.004 | 0.004 | 0.003 | 0.003 |
| Wt./ft | lbs. | 0.063 | 0.058 | 0.054 | 0.051 | 0.049 | 0.046 | 0.042 | 0.039 | 0.036 |

FIG. 2A

| | | | | | | | | | | |
|---|---|---|---|---|---|---|---|---|---|---|
| Strength | | | | | | | | | | |
| Yld | ksi | 75 | 60 | 84 | 87 | 91 | 95 | 102 | 109 | 117 |
| Ult. | ksi | | | | | | | | | |
| M-yld. | in-lbs | 276 | 276 | 277 | 275 | 275 | 276 | 276 | 276 | 276 |
| Pct. of Base | | 100 | 100 | 100 | 100 | 100 | 100 | 100 | 100 | 100 |
| M-Ult. | in-lbs | 0 | 0 | 0 | 0 | 0 | 0 | 0 | 0 | 0 |
| Yield Pr | psi | 27273 | 25263 | 24247 | 23220 | 22372 | 21803 | 20832 | 19943 | 19258 |
| Burst Pr | psi | 0 | 0 | 0 | 0 | 0 | 0 | 0 | 0 | 0 |
| Deflection | | | | | | | | | | |
| Span 30 | in/lb | 0.079 | 0.079 | 0.079 | 0.079 | 0.079 | 0.079 | 0.079 | 0.079 | 0.079 |
| Bend Sti | lb/in | 12.6 | 12.6 | 12.6 | 12.6 | 12.6 | 12.6 | 12.6 | 12.6 | 12.6 |
| Pct. of Base | | 100 | 100 | 100 | 100 | 100 | 100 | 100 | 100 | 100 |
| Cantil. 3 in | | 1.269 | 1.267 | 1.267 | 1.265 | 1.270 | 1.270 | 1.265 | 1.265 | 1.272 |
| Bend Sti | lb/in | 0.8 | 0.8 | 0.8 | 0.8 | 0.8 | 0.8 | 0.8 | 0.8 | 0.8 |
| Twist | deg/ft-l | 0.0068 | 0.0067 | 0.0067 | 0.0067 | 0.0068 | 0.0068 | 0.0067 | 0.0067 | 0.0068 |
| Tor. Stiff | in-lb/d | 148.06 | 148.24 | 148.24 | 148.46 | 147.86 | 147.86 | 148.50 | 148.45 | 147.67 |

FIG. 2B

METAL MATRIX COMPOSITE SHAFTS FOR GOLF CLUBS

CROSS REFERENCE TO RELATED APPLICATIONS, IF ANY

The present application hereby claims the priority of provisional application Ser. No. 60/072,476 filed Jan. 26, 1998.

BACKGROUND OF THE INVENTION AND PRIOR ART

1. Field of the Invention

The present invention relates to the field of manufacture of golf club shafts, particularly of aluminum or aluminum alloys which must have a minimum defined stiffness and which benefit from weight reduction. As referred to herein, the term "defined stiffness" for golf shafts refers to a measured vertical deflection of the tip end of a shaft from which a weight is suspended when the butt or handle end of the shaft is clamped to horizontally support the shaft in cantilever fashion. The industry defined S, R, L, X stiffiess scale for golf shafts is well known. Defined stiffnesses of other sports articles are also known or are easily determinable.

2. Prior Art

Tubular sporting articles such as baseball bats and golf club shafts made of metal materials such as aluminum alloys which have a maximum modulus of elasticity of about 10.4 are well known. Throughout this disclosure, elastic (Young's) modulii expressed for example by the number 11 will be understood by persons skilled in the art to mean $11\times10^6$ psi.

As defined herein, the term metal matrix composite (MMC) refers to a metal or metal alloy having an undissolved portion of non-metal reinforcing fibers, platelets or particles uniformly dispersed therein. MMCs comprising alloys of metals such as aluminum reinforced with non-metal fibers or particles such as ceramic particles are known and, although their use has been broadly suggested for golf shafts, the usual reinforced aluminum alloys typically have elastic modulii significantly in excess of about 13 and may be formulated to have elastic modulii as high as 20 or 30 or even above pending upon the end use of the products for which they are intended. These MMC modulii are considered excessive and thus inherently unsuitable for golf shafts.

The elastic modulus of MMCs increases as the volume percent of reinforcing fibers such as carbon, silicon carbide or boron fibers or platelets or particles of ceramic, e.g., aluminum oxide, silicon carbide, etc. in the product increase from about 15% to 40% by volume. These MMC materials are of approximately the same density as or slightly higher density than non-reinforced alloys but are considerably stiffer, e.g., from 30 to 50 percent stiffer, than the same un-reinforced aluminum alloy. On the other hand, the tensile yield strength of aluminum alloy MMCs increases relatively insignificantly (less than 10%) over that of un-reinforced aluminum alloys despite the added non-metal reinforcement. Unlike alloying elements that dissolve in molten aluminum, the added reinforcing platelets, fibers or ceramic particles in MMCs remain in platelet, fiber or powder form with no significant chemical reaction. MMCs may therefore be generally categorized as continuous reinforced alloys or as discontinuous reinforced alloys. Continuous reinforced alloys employ strands or fibers for the reinforcement whereas discontinuously reinforced alloys use reinforcement in particulate or platelet form.

Continuously reinforced alloys or MMCs employing silicon carbide fibers have been suggested for use in tubular sports articles such as bicycle frame parts which require light weight and substantial stiffness. Continuously reinforced MMCs have not heretofore been found acceptable for commercial use in shaped articles such as golf club shafts further because of relatively poor workability characteristics of continuously reinforced MMCs. Mechanical workability is essential to obtain the desired shaft shapes without sacrifice of acceptable strength, flexibility, light weight and good fatigue resistance. MMC technology has generally emphasized the addition of substantial proportions of reinforcing fibers or powders to the matrix alloy to obtain substantially greater stiffness. This has resulted in MMCs which are inadequately drawable and thus unsuitable for formation of tubular shapes such as golf shafts which not only must have a tapered configuration with thin walls for light weight but must be reformed from the original tubular shape to form an enlarged cylindrical butt or handle end and a re-shaped short cylindrical tip end. Additional variations in the shaft wall thickness to create a kick point of maximum shaft flexibility at a desired position or to form the more recently introduced "bubble shaft" configurations having an enlarged section proximate the lower portion of the butt end of the shaft require additional steps in the forming process. Also, MMCs work harden relatively quickly which makes tapering of articles such as golf club shafts very difficult.

Various MMCs have been extensively studied but golf shafts manufactured therefrom for test purposes have previously proven unsuitable. U.S. Pat. No. 4,702,770 issued Oct. 27, 1987 to Pyzic, et al. is one example representative of boron carbide aluminum composite technology.

Accordingly, improved tubular shaped metal sporting articles having a defined stiffness and reduced weight due to a reduction in wall thickness, and with adequate strength despite this reduction in wall thickness are always desired. Shaped metal sporting articles such as golf shafts with high strength-to-weight ratios without sacrificing flexibility, torsional resistance or fatigue resistance and possessing workability properties required for economy of manufacture and ease of golf club assembly and repair are particularly desirable.

SUMMARY OF THE INVENTION

The present invention provides a golf shaft formed from a metal matrix composite material, said shaft comprising a handle portion, a tapered portion and a tip portion, the final dimensions of at least said tapered portion and said tip portion being re-formed from the starting dimensions of a tubular metal matrix composite material starting stock to provide a shaft with variations in wall thickness, said metal matrix composite comprising an aluminum alloy matrix having discontinuous reinforcement particles therein, and a minimum modulus of elasticity of 10.4 and a minimum yield strength and minimum modulus of elasticity related by the equation:

$$Y=71+6.84(E-10.4)$$

where Y is yield strength in KSI and E is modulus of elasticity in millions of pounds per square inch (MSI)—i.e. $\times10^6$ psi.

BRIEF DESCRIPTION OF THE DRAWINGS

FIG. 1 is a table of material properties of various MMC's used for manufacture of golf shafts intended for use in iron type golf clubs.

FIG. 2 is a table of material properties of various MMC's used for manufacture of golf shafts intended for use in wood type golf clubs.

DESCRIPTION OF THE PREFERRED EMBODIMENT

FIGS. 1 and 2 are tables respectively showing tip analyses for shafts intended for iron and wood type golf clubs displaying selected material properties of various MMC's which have been extensively examined for possible suitability for golf shaft manufacture. Note that the tip wall thickness of the iron shafts from FIG. 1 is thicker than the wall thickness for wood type shafts in FIG. 2 despite a smaller outside diameter for the tip end of the iron shafts. Although this is the ordinary relationship, in wood shafts designed with a smaller outside diameter at the tip, e.g., 0.312", the tip wall thickness may be somewhat greater than for a corresponding iron shaft.

In each figure of drawings nine MMC formulations were compared with a base unreinforced 7001 aluminum alloy (#1 in FIGS. 1 and 2). The desired minimum deflection and modulus of elasticity are known and the objective is to obtain the MMC formulations, if any, best suited to meet the design criteria and which possess adequate yield strength.

Figure 3:
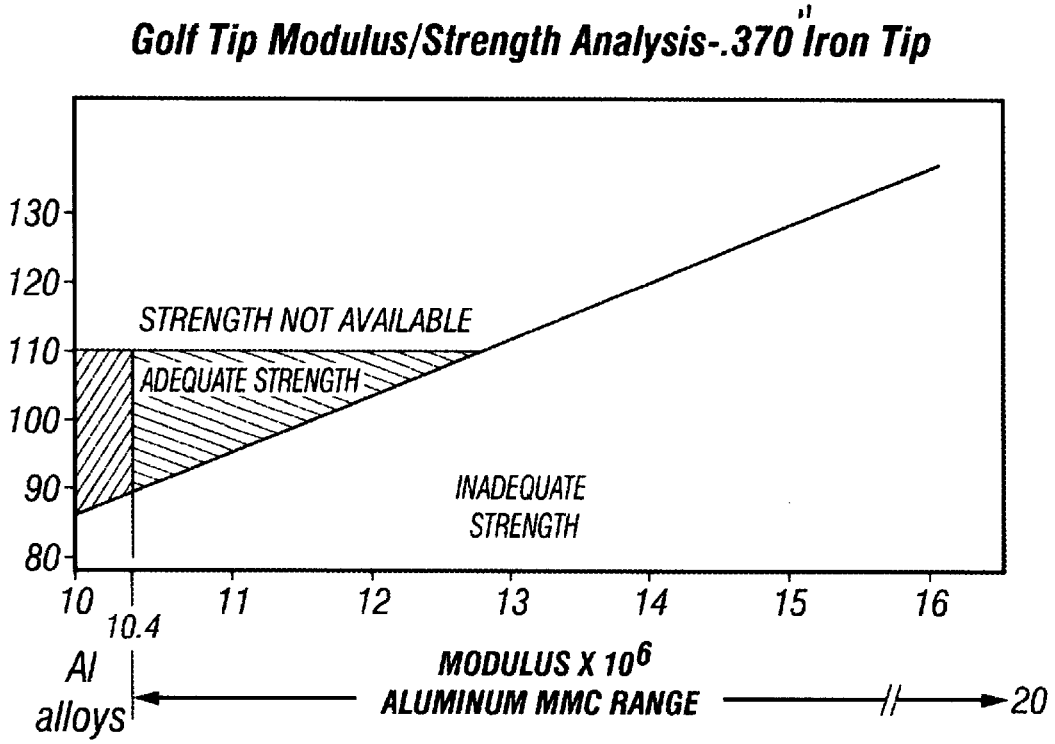
FIG. 3 is a golf shaft strength analysis graph made from the data of FIG. 1 plotting minimum strength vs. minimum modulus of elasticity of MMCs for shafts intended for use in iron type golf clubs.

FIG. 3 shows a product design line drawn from the data of FIG. 1 determined by applicant to be minimum requirements golf shafts for iron type clubs showing tensile yield strength on the vertical axis expressed in kilopounds per square inch (ksi) and elastic modulus on the horizontal axis. The design objective is to reduce the weight of a golf shaft by reducing the wall thickness of the shaft while maintaining a required minimum deflection stiffniess to determine whether acceptable shafts can be manufactured through the use of one or more novel MMC formulations which must be mechanically workable to form the desired shaft configuration from a tubular stating stock. At the left side of FIG. 1, the shaded trapezoidal area represents, for comparison purposes, unreinforced aluminum alloys which have Young's modulii in the range of from 10–10.4 and maximum strength of about 110 ksi. Since the yield strength of an aluminum alloy MMC does not materially increase above that of the corresponding un-reinforced aluminum alloy, the optimum MMC design area is the shaded triangular area above the design line and to the right of the trapezoidal shaded alloy area. Instead of plotting strength on the vertical axis, those skilled in the art will understand that similar design line graphs can be constructed to illustrate the optimum design area for weight reduction or wall thickness reduction. As will be apparent, any reduction in wall thickness results in a corresponding reduction in shaft weight, strength and stiffness unless different material formulations are compared.

Figure 4:
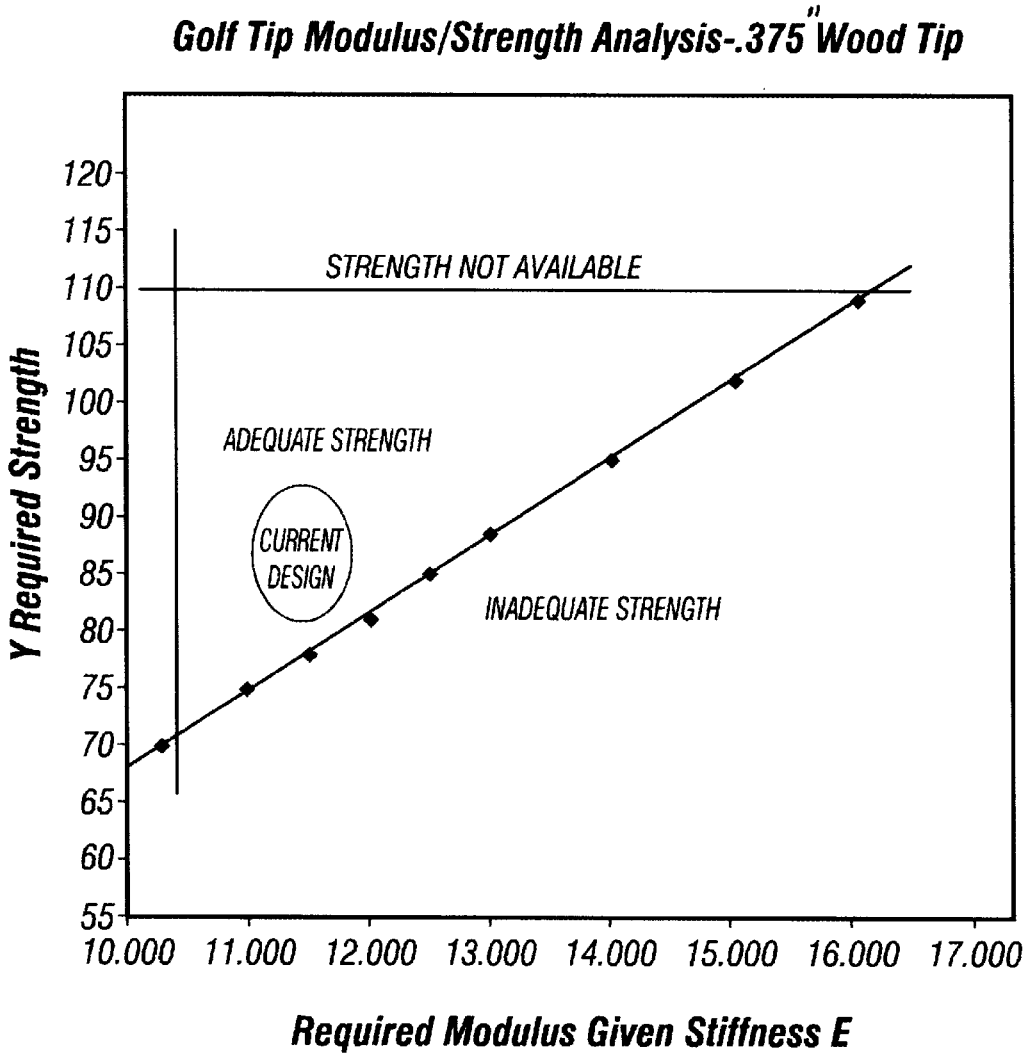
FIG. 4 is a golf shaft strength analysis graph made from the data of FIG. 2 plotting minimum strength vs. minimum modulus of elasticity of MMCs for shafts intended for use in wood type golf clubs.

FIG. 4 is similar to FIG. 3 but shows the design area required for shafts intended for use in wood type golf clubs. It will be noted that the strength/modulus line is below that shown in FIG. 3 for shafts for iron type clubs. Shafts for woods are ordinarily designed to be weaker than shafts for irons because golfers more frequently hit the ground harder than intended with irons. Since the tip end of a golf shaft is subjected to the greatest stress concentration at the point where the shaft emerges from the head, this is where shaft failure most frequently occurs. Accordingly greater strength is required for shafts for iron type clubs.

Figure 5:
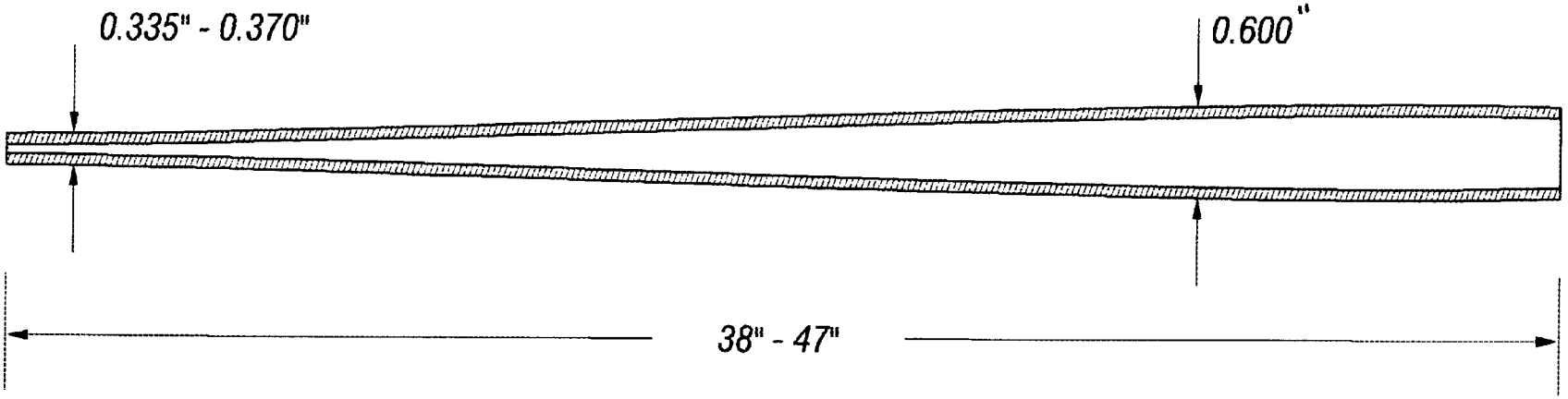
FIG. 5 is a cross section view of a typical golf club shaft.

FIG. 5 shows a horizontal cross-section of a typical golf shaft having wall thickness changes along the length of the shaft. The wall thickness at the handle end of the shaft is thinnest since the handle or butt end has the largest diameter. Conversely, the wall thickness at the tip end is largest. Transition points between the tip and the tapered portion of the shaft and between the butt and the tapered portion of the shaft are formed as the shaft is mechanically worked to its final shape from a tubular stating stock by well known metal manufacturing techniques. The shaft may also be formed with an enlarged bubble section proximate the juncture between the taper and the butt or with step tapering rather than continuous tapering or with any of a number of configurations depending only on the performance characteristics desired and the rules of golf. Accordingly, numerous metal formation steps may be required and the MMC formulation must be able to withstand the working steps.

Set forth below is a table showing the composition of MMC's having discontinuous silicon carbide (SiC) therein which were designed to have equal strength and stiffness as the Base alloy, but with progressively lighter weight and which are identified in FIGS. 1 and 2 as Nos. 2–9, respectively. The Base is 7001 unreinforced aluminum alloy. The weight percentage of silicon carbide additive conforms to the formula SiC=4.166(E−10.4).

| | Base | | | | | | | | |
|---|---|---|---|---|---|---|---|---|---|
| | #1 | #2 | #3 | #4 | #5 | #6 | #7 | #8 | #9 |
| % SiC | 0 | 2.5 | 5.0 | 6.6 | 8.7 | 10.8 | 15.0 | 19.2 | 23.3 |
| E | 10.4 | 11.0 | 11.6 | 12.0 | 12.5 | 13.0 | 14.0 | 15.0 | 16.0 |

Testing and Analysis

One batch of golf shafts for test purposes was formed from an MMC comprised of a commercially available 7071 aluminum matrix incorporating 12% silicon carbide particulate reinforcement and an elastic modulus of 15. This MMC had a density of 0.103 lbs/in3. MMC tubes having an outside diameter of 0.600 and a wall thickness of about 0.020" were first tapered in a two step process and test samples having a wall thickness of about 0.025" were successfully tapered in a one step process to form golf club shafts; however, an unacceptable number of the resulting shafts were found to exhibit micro-cracks in the tip end and, when straightened in an auto-straightener, the brittle shafts experienced frequent breakage and were thus unsuitable for mass production.

Other commercially available MMCs were studied but none was believed to possess the characteristics required for manufacture of golf shafts. It was then considered that testing of MMCs having a significantly lower proportion of reinforcing composite than is ordinarily available from commercial suppliers of MMC stock should be studied since one or more of them might prove beneficial for golf shaft manufacture. An MMC was then specially formulated according to applicant's specification comprising 7090 aluminum alloy reinforced with 2.5 w % boron carbide particles. This MMC, when tested, had a density of 0.099 lbs/in3 and a Young's modulus of 11.5 and thus appeared to meet the golf shaft design criteria.

The above test results led applicant to conclude that continuously reinforced alloys, namely those with fiber rather than particulate or platelet reinforcement were unacceptable but that a discontinuously reinforced alloy, i.e. one with particulate or platelet reinforcing or with very short length fibers which essentially act like particle reinforcement might prove acceptable for golf shaft manufacture. Particles having an aspect ratio of up to 3:1 are considered acceptable and are considered discontinuous.

Further testing and experience gained from unsuccessful test results led to the determination that discontinuously reinforced 7000 Series aluminum alloy MMCs, particularly 70XX alloy MMCs, can be successfully employed for the manufacture of shaped tubular sporting articles by ensuring that the starting blank of MMC tubular stock possesses a modulus of elasticity in the range of about 10.6–12.5, a percentage elongation of at least 4% for adequate workability, adequate strength and a hardness which does not materially damage cutting and shaping tools. Applicant has also concluded that particle shape, rather than particle composition, has a more significant abrasive effect which rapidly damages cutting and shaping tools. Fine particles, rather than fibers or platelets have been found to be less detrimental to cutting and shaping tools. The required properties of an MMC which meets the design criteria falling within the shaded triangular areas of FIGS. 3 and 4 are likely possessed by a number of different MMCs comprised of a metal matrix of various alloys of aluminum and discontinuous non-metal ceramic reinforcement particles in weight percentages preferably in the range of from about 1–8% and not exceeding about 10%. Without limitation, such MMCs may comprise alloy matrices of 7049, 7050, 7075, 7178 and 7475 aluminum. Golf shafts comprised of such MMCs can be reliably and economically produced.

At the time of this disclosure, the presently preferred MMC for production of golf shafts is produced from an aluminum alloy containing about 11% zinc which is available from PEAK Company of Germany. The MMC contains 5% loading of spherical silicon carbide particles and has a Young's modulus of 11.5. Tubular metal matrix composite material stock formed by a spray casting process is presently preferred.

SUMMARY

Various methods for forming tapered metal golf club shafts are well known and need not be modified for forming MMC shafts. A starting stock aluminum alloy tube having larger diameter and wall thickness than the final shaft size is first drawn to form the butt end of the shaft with an outside diameter of about 0.600" to receive a wound or slip on grip. Then, the remainder of the shaft is tapered and tip end of the shaft which receives the clubhead may remain tapered or then be formed to a cylindrical configuration. A cylindrical tip section of the finished shaft will typically have an outside diameter of from about 0.335"–0.400". The wall thickness of the shaft may also be varied along the length of the shaft. As is known, golf shafts are drawn by inserting a mandrel through one end of the tubular starting stock and pulling through a die to cause the wall thickness of the tube to be reduced. The tapering may be accomplished by one of a variety of methods including hammering or swaging; step sinking; roto-drawing through a tube reducer; or by various combinations of these methods. Variations of shaft wall thickness are shown along the length of the shaft.

Persons skilled in the art will appreciate that various modifications of the preferred embodiment may be made without departing from the teachings herein and that the scope of protection is defined by the claims which follow. For example, golf shafts formed from other aluminum alloy bases reinforced with discontinuous non-metal particles or platelets other than SiC may be fabricated so long as the minimum yiels strength and modulus of elasticity are related as described and claimed.

What is claimed is:

1. A golf shaft formed from a metal matrix composite material, said shaft comprising a handle portion, a tapered portion and a tip portion, the final dimensions of at least said tapered portion and said tip portion being re-formed from the starting dimensions of a tubular metal matrix composite material starting stock to provide a shaft with variations in wall thickness, said metal matrix composite comprising a 7XXX series aluminum alloy matrix having discontinous reinforcement particles therein, a maximum modulus of elasticity of 12.5, a minimum modulus of elasticity and a minimum yield strength being related by the equation: $Y=71+6.84(E-10.4)$ where Y is yield strength in kilopounds per square inch and E is modulus of elasticity in millions of pounds per square inch, and wherein a minimum modulus of elasticity is no lower than 10.4 and a minimum yield strength is no lower than 71.

2. The golf shaft of claim 1, wherein said alloy is a 70XX Series alloy.

3. The golf shaft of claim 2, wherein said metal matrix composite is a spray cast metal matrix composite.

4. The golf shaft of claim 1, wherein said shaft is formed with a cylindrical tip section having an outside diameter of about 0.370", and has a minimum yield strength and minimum modulus of elasticity related by the equation: $Y=90+8.33(E-10.4)$ for use as a shaft of an iron type golf club.

5. The golf shaft of claim 1, wherein said shaft is formed with a cylindrical tip section having an outside diameter of about 0.375", a modulus of elasticity of about 11.5 and a yield strength of about 85 KSI for use as a shaft of a wood type golf club.

6. The golf shaft of claim 1, wherein said reinforcement particles are present in said metal matrix composite in the range of from about 1–10% by weight.

7. The golf shaft of claim 6, wherein said particles are non-metallic.

8. The golf shaft of claim 7, wherein said particles are ceramic particles.

9. The golf shaft of claim 6, wherein said particles are selected from the group consisting of metal oxides and metal silicates.

10. The golf shaft of claim 6, wherein said reinforcement particles comprise spherical oxide particles in an amount of about 5% by weight of said MMC.

11. The golf shaft of claim 1, wherein said reinforcement particles are silicon carbide.

12. The golf shaft of claim 11, wherein about 4.8% w of said reinforcement particles are present in said metal matrix composite.

13. The golf shaft of claim 1, wherein said reinforcement particles comprise silicon carbide in a percentage amount by weight which conforms to the formula $SiC=4.166(E-10.4)$.

14. The golf shaft of claim 1, wherein said alloy is an aluminum alloy containing zinc and magnesium and said reinforcement particles are present in a percentage amount R% by weight which substantially conforms to the formula $R\%=4.166\ (E-10.4)$.

* * * * *